US010030859B2

(12) United States Patent
Langlois

(10) Patent No.: US 10,030,859 B2
(45) Date of Patent: Jul. 24, 2018

(54) ANIMATED LIGHT SWITCH SYSTEM

(71) Applicant: Guy Langlois, Charlemagne (CA)

(72) Inventor: Guy Langlois, Charlemagne (CA)

( * ) Notice: Subject to any disclaimer, the term of this patent is extended or adjusted under 35 U.S.C. 154(b) by 0 days.

(21) Appl. No.: 15/379,648

(22) Filed: Dec. 15, 2016

(65) Prior Publication Data

US 2018/0172255 A1 Jun. 21, 2018

(51) Int. Cl.
*H01H 23/14* (2006.01)
*F21V 23/04* (2006.01)
*H04R 1/02* (2006.01)

(52) U.S. Cl.
CPC ..... *F21V 23/0435* (2013.01); *H01H 23/141* (2013.01); *H04R 1/028* (2013.01)

(58) Field of Classification Search
CPC .... H01H 23/12; H01H 23/141; H01H 23/143; H01H 23/148; H01H 23/16; H01H 9/16; F21V 15/01; F21V 33/00; F21V 33/0004
USPC ..... 200/308, 331; 362/95, 644
See application file for complete search history.

(56) References Cited

U.S. PATENT DOCUMENTS

| | | | | |
|---|---|---|---|---|
| 2,717,582 | A | 9/1955 | Scherenberg | |
| 3,825,710 | A | 7/1974 | Roberts et al. | |
| 4,999,465 | A | 3/1991 | Kuhlman | |
| D549,092 | S | 8/2007 | Nabers | |
| 2005/0259421 | A1 | 11/2005 | Smith | |
| 2008/0198703 | A1 | 8/2008 | Dickmeyer | |
| 2012/0268901 | A1* | 10/2012 | Jeschko | H01H 23/06 361/747 |

FOREIGN PATENT DOCUMENTS

| | | | | |
|---|---|---|---|---|
| GB | 2380858 A | * | 4/2003 | H01H 3/02 |
| WO | WO02061778 | | 8/2002 | |

* cited by examiner

*Primary Examiner* — Vanessa Girardi

(57) ABSTRACT

An animated light switch system includes a light switch that is coupled to a wall. The light switch may be manipulated. The light switch includes a lever and a faceplate. An action unit is coupled to the light switch and the action unit may be manipulated. The action unit engages the lever such that the action unit turns the light switch on and off when the action unit is manipulated. A sound unit is coupled to the action unit. The sound unit emits an audible sound when the light switch is turned on and off.

15 Claims, 6 Drawing Sheets

ANIMATED LIGHT SWITCH SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to light switch devices and more particularly pertains to a new light switch device for combining an action figure and a light switch.

BRIEF SUMMARY OF THE INVENTION

An embodiment of the disclosure meets the needs presented above by generally comprising a light switch that is coupled to a wall. The light switch may be manipulated. The light switch includes a lever and a faceplate. An action unit is coupled to the light switch and the action unit may be manipulated. The action unit engages the lever such that the action unit turns the light switch on and off when the action unit is manipulated. A sound unit is coupled to the action unit. The sound unit emits an audible sound when the light switch is turned on and off.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
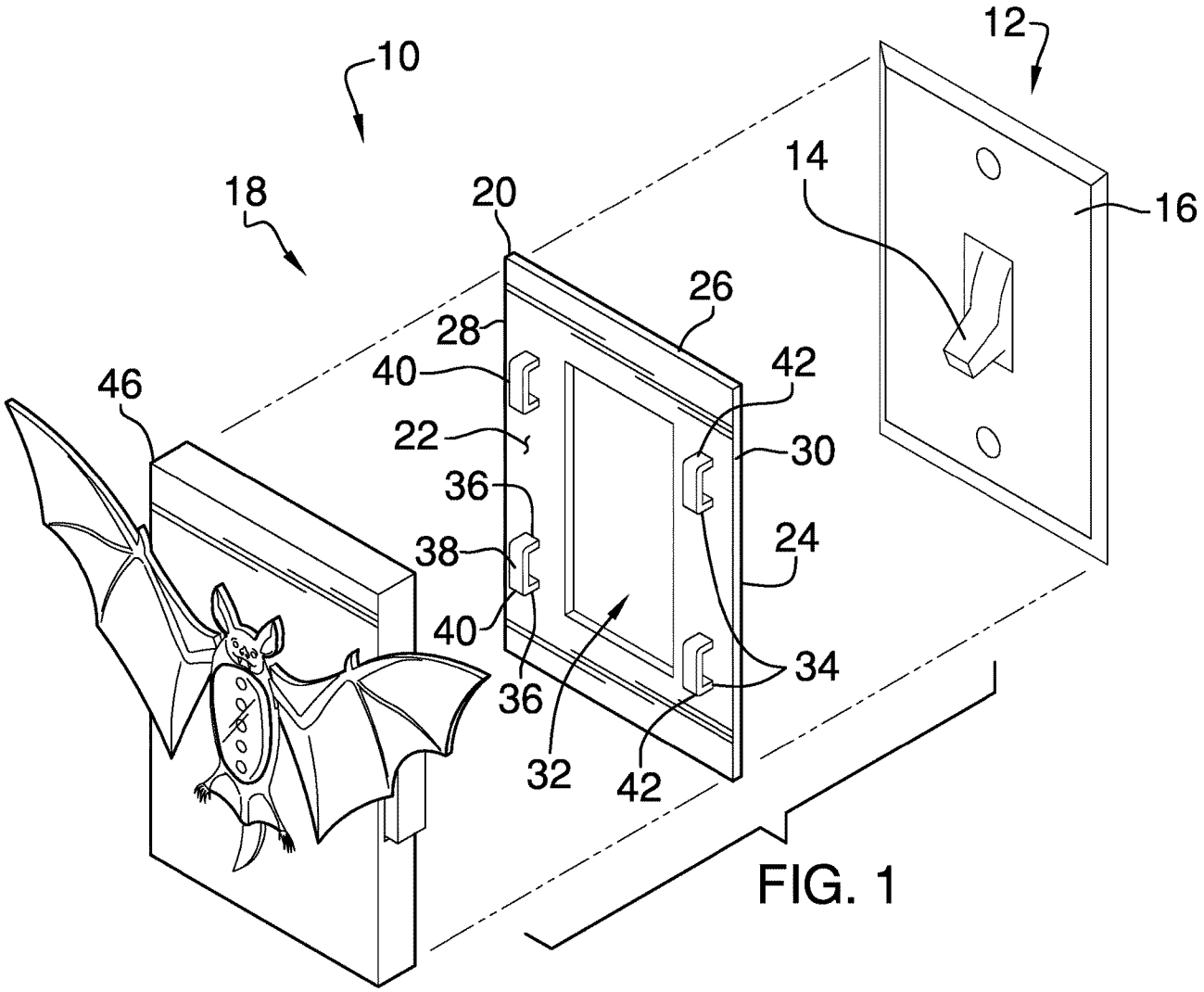
FIG. 1 is an exploded perspective view of an animated light switch system according to an embodiment of the disclosure.
Figure 2:
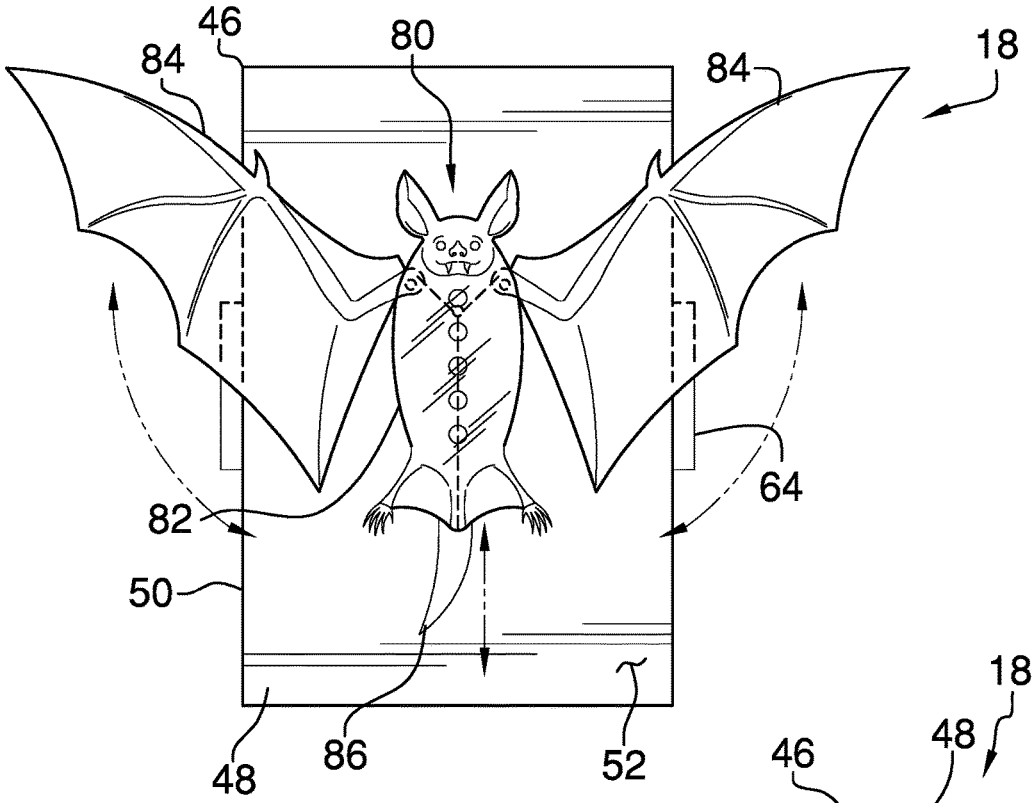
FIG. 2 is a front view of second plate of an embodiment of the disclosure.
Figure 3:
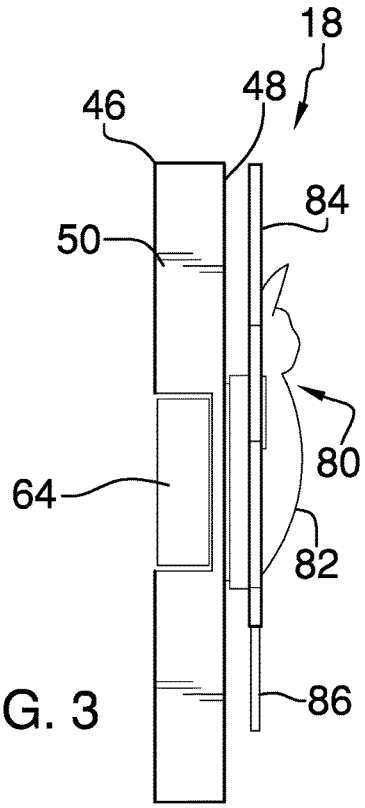
FIG. 3 is a left side view of second plate of an embodiment of the disclosure.
Figure 4:
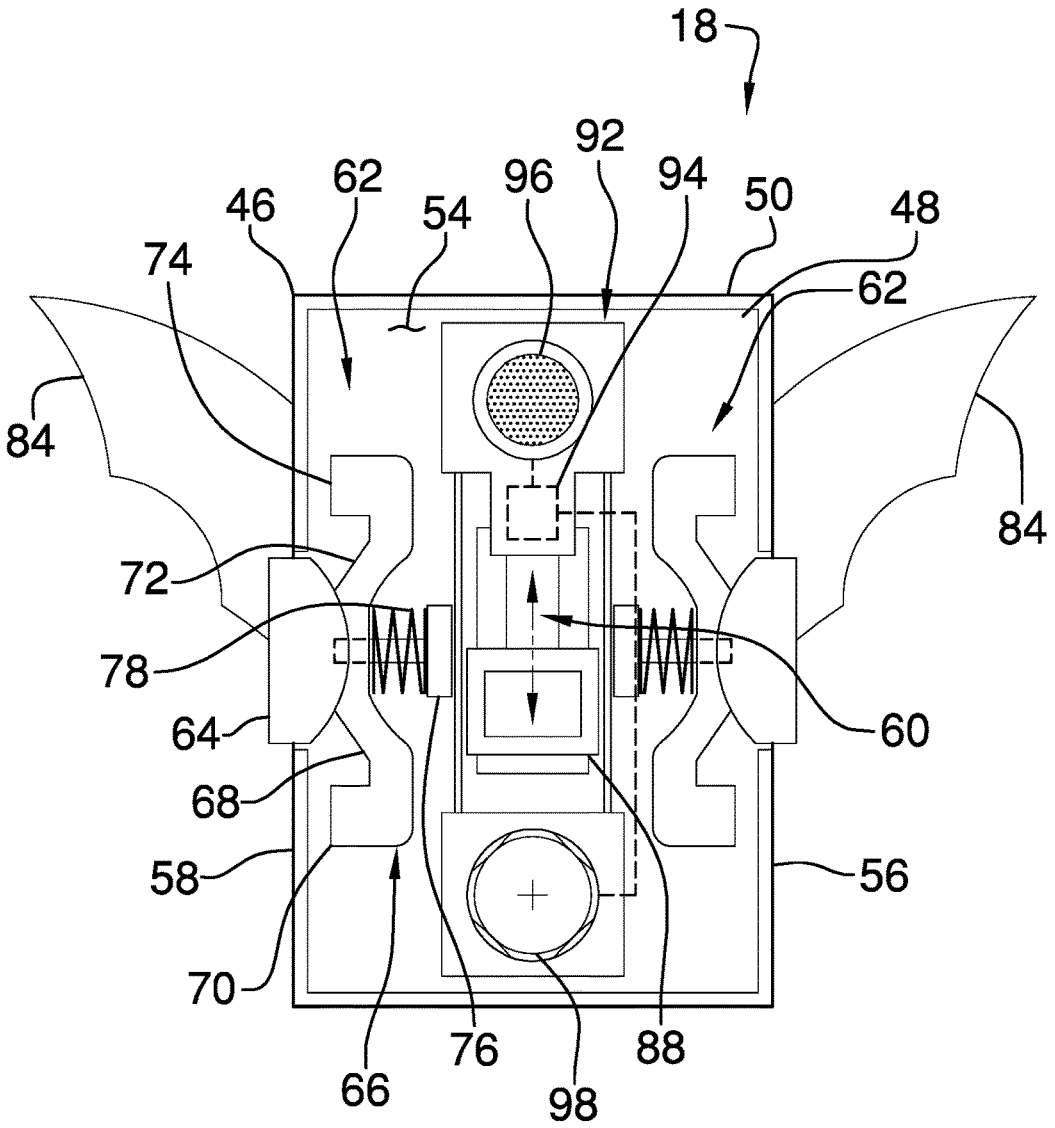
FIG. 4 is a back view of second plate of an embodiment of the disclosure.
Figure 5:
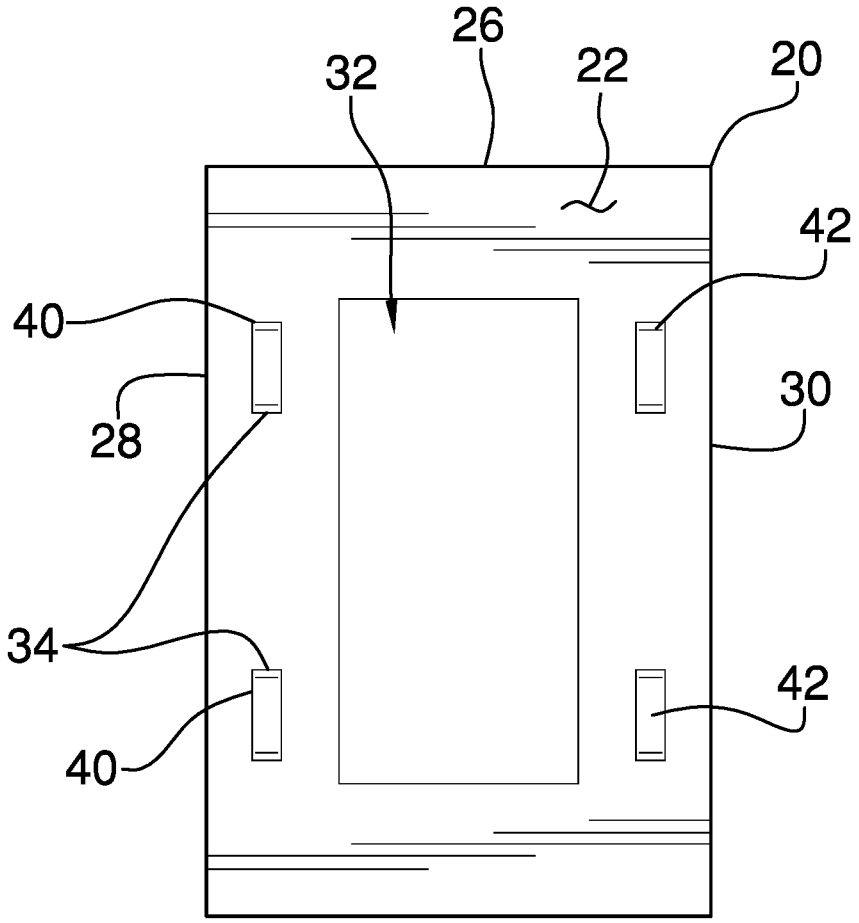
FIG. 5 is a front view of first plate of an embodiment of the disclosure.
Figure 6:
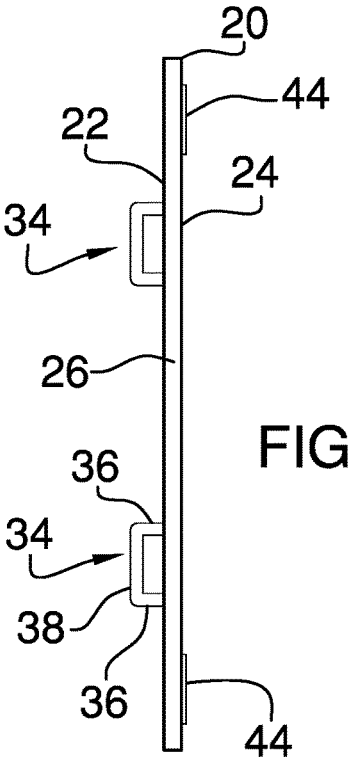
FIG. 6 is a right side view of a first plate of an embodiment of the disclosure.
Figure 7:
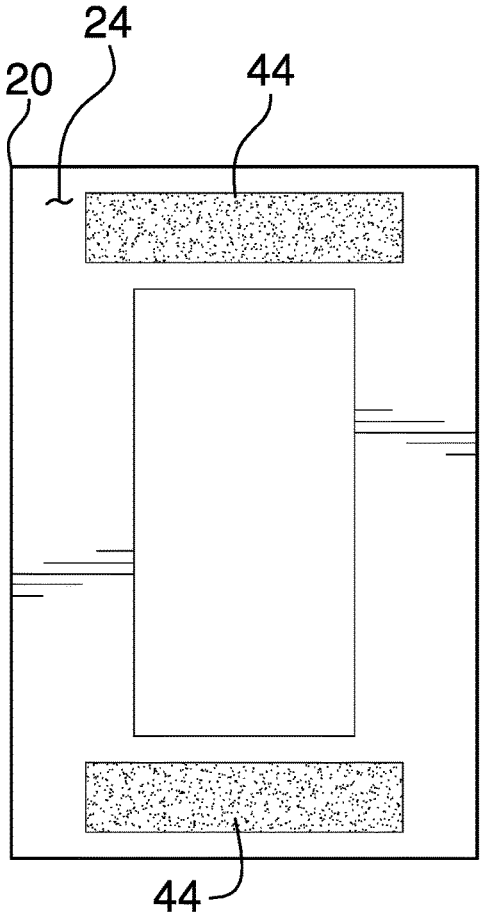
FIG. 7 is a back view of first plate of an embodiment of the disclosure.

With reference now to the drawings, and in particular to FIGS. 1 through 8 thereof, a new light switch device embodying the principles and concepts of an embodiment of the disclosure and generally designated by the reference numeral 10 will be described.

As best illustrated in FIGS. 1 through 8, the animated light switch system 10 generally comprises a light switch 12. The light switch 12 is coupled to a wall or the like. The light switch 12 may be manipulated. The light switch 12 includes a lever 14 and a faceplate 16.

An action unit 18 is coupled to the light switch 12. The action unit 18 may be manipulated. The action unit 18 engages the lever 14. Thus, the action unit 18 turns the light switch 12 on and off when the action unit 18 is manipulated.

The action unit 18 comprises a first plate 20 that has a first surface 22, a second surface 24 and a peripheral edge 26 extending therebetween. The peripheral edge 26 has a first lateral side 28 and a second lateral side 30. The first plate 20 has a first slot 32 extending through the first surface 22 and the second surface 24. The first plate 20 is positioned on the faceplate 16 and the second surface 24 abuts the faceplate 16.

A plurality of fasteners 34 is provided. Each of the fasteners 34 has a pair of first arms 36 and a second arm 38 extending between each of the first arms 36. The first arms 36 are spaced apart from each other. Each of the first arms 36 is coupled to the first surface 22 of the first plate 20. Moreover, the second arm 38 is spaced from the first surface 22.

The plurality of fasteners 34 includes a pair of first fasteners 40. The plurality of fasteners 34 includes a pair of second fasteners 42. Each of the first fasteners 40 is positioned between the first lateral side 28 of the first plate 20 and the first slot 32. Each of the second fasteners 42 is positioned between the second lateral side 30 of the plate and the first slot 32.

A pair of couplers 44 is provided. Each of the couplers 44 is coupled to the second surface 24 of the first plate 20. Each of the couplers 44 engages the faceplate 16 to retain the first plate 20 on the faceplate 16. Each of the couplers 44 may comprise double sided adhesive tape or the like.

A second plate 46 is provided. The second plate 46 has a first wall 48 and an exterior wall 50 extending outwardly from the first wall 48. The first wall 48 has a front surface 52 and a back surface 54. The exterior wall 50 is coextensive with a perimeter of the back surface 54. The exterior wall 50 has a first side 56 and a second side 58. The first wall 48 has a second slot 60 extending therethrough.

A pair of retaining units 62 is provided. Each of the retaining units 62 is movably coupled to the second plate 46 and each of the retaining units 62 may be manipulated. Each of the retaining units 62 engages associated ones of the fasteners 34. Thus, the second plate 46 is removably coupled to the first plate 20. Each of the retaining units 62 is aligned with an associated one of the first side 56 and the second side 58 of the exterior wall 50.

Each of the retaining units 62 comprises a button 64 that may be manipulated. The button 64 extends through the exterior wall 50 of the second plate 46. A grip 66 is coupled to the button 64 and the grip 66 extends along the back surface 54 of the second plate 46. The grip 66 has a first leg 68 and a first foot 70. Moreover, the grip 66 has a second leg 72 and a second foot 74.

The first leg 68 and the second leg 72 extend away from each other. Each of the first foot 70 and the second foot 74 is directed toward the exterior wall 50. Each of the first foot 70 and the second foot 74 extend between the first surface 22 of the first plate 20 and the second arm 38 of an associated one of the fasteners 34. Thus, the second plate 46 is retained on the first plate 20.

A stop 76 is coupled to the back surface 54 of the second plate 46 and the stop 76 is spaced from the grip 66. A biasing member 78 extends between the stop 76 and the grip 66. The biasing member 78 biases each of the first foot 70 and the second foot 74 toward the exterior wall 50. Thus, each of the first foot 70 and the second foot 74 engages the associated fastener. Each of the first foot 70 and the second foot 74 disengages the associated fastener 34 when the button 64 is manipulated. Thus, the second panel is removable from the first plate 20.

An action FIG. 80 is movably coupled to the front surface 52 of the second plate 46. The action FIG. 80 may be manipulated. The action FIG. 80 is aligned with the second slot 60 in the second plate 46. The action FIG. 80 has a body 82, a plurality of limbs 84 and a tail 86. Each of the limbs 84 and the tail 86 is hingedly coupled to the body 82. Thus, each of the limbs 84 and the tail 86 may be manipulated.

The action FIG. 80 includes a saddle 88 extending through the second slot 60. The saddle 88 is operationally coupled to the tail 86. The saddle 88 engages the lever 14 on the light switch 12. Thus, the saddle 88 turns the light switch 12 on and off when the tail 86 is manipulated.

Figure 8:
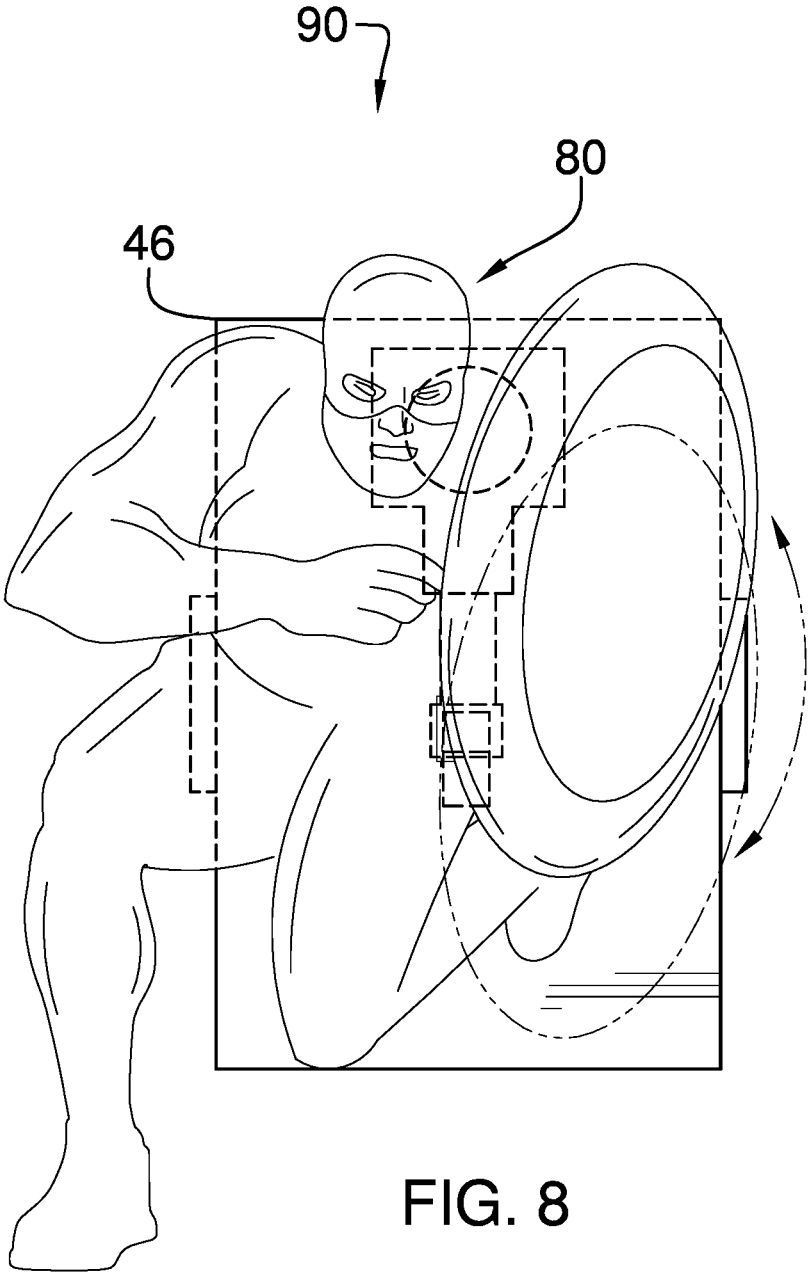
FIG. 8 is a perspective view of an alternative embodiment of the disclosure.

The action FIG. 80 may be structured to resemble a bat or the like. Each of the limbs 84 may be structured to resemble bat wings. In an alternative embodiment 90 as shown in FIG. 8, the action FIG. 80 may be structured to resemble a super hero. The shield may be movably coupled to the action FIG. 80 and the shield may be manipulated. The saddle 88 may be operationally coupled to the shield.

A sound unit 92 is provided. The sound unit 92 is coupled to the action unit 18. The sound unit 92 emits an audible sound when the light switch 12 is turned on and off. Thus, the sound unit 92 enhances turning the switch on and off.

The sound unit 92 comprises a processor 94 that is coupled to the second surface 24 of the second plate 46. The processor 94 selectively generates an audible sequence. The processor 94 is in electrical communication with the tail 86. Thus, the processor 94 generates the audible sequence when the tail 86 is manipulated. The processor 94 includes an electronic memory and the electronic memory stores audio data. The processor 94 may be an electronic processor 94 or the like.

A speaker 96 is coupled to the second surface 24 of the second plate 46. The speaker 96 emits an audible sound. The speaker 96 is electrically coupled to the processor 94. Thus, the speaker 96 receives the audio data when the processor 94 generates the audible sequence. The audio data may comprise the sound of a bat screeching or the like. Alternatively, the audio data may comprise a verbal statement relating to the super hero.

A power supply 98 is provided. The power supply 98 is coupled to the second surface 24 of the second plate 46. The power supply 98 is electrically coupled to the processor 94. The power supply 98 comprises at least one battery.

In use, the first plate 20 is coupled to the light switch 12. The button 64 corresponding to each of the retaining units 62 is depressed. The second plate 46 is positioned on the first plate 20. The button 64 corresponding to each of the retaining units 62 is released. The grip 66 corresponding to each of the retaining units 62 engages the associated fasteners 34. Thus, the second plate 46 is retained on the first plate 20. The tail 86 is manipulated to turn the light switch 12 on and off. The sound unit 92 emits the audible sound when the tail 86 is manipulated.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An animated light switch system comprising:

a light switch being coupled to a wall wherein said light switch is configured to be manipulated, said light switch including a lever and a faceplate;

an action unit being coupled to said light switch wherein said action unit is configured to be manipulated, said action unit engaging said lever such that said action unit turns said light switch on and off when said action unit is manipulated, said action unit including a first plate;

a sound unit being coupled to said action unit wherein said sound unit is configured to emit an audible sound when said light switch is turned on and off;

a second plate having a first wall and an exterior wall extending outwardly from the first wall, said first wall having a front surface and a back surface, said exterior wall being coextensive with a perimeter of said back surface, said exterior wall having a first side and a second side, said first wall having a second slot extending therethrough;

a plurality of fasteners; and a pair of retaining units, each of said retaining units being movably coupled to said second plate wherein each of said retaining units is configured to be manipulated, each of said retaining units engaging associated ones of said fasteners such that said second plate is removably coupled to said first plate, each of said retaining units being aligned with an associated one of said first side and said second side of said exterior wall.

2. The system according to claim 1, further comprising an action figure being movably coupled to said front surface of said second plate wherein said action figure is configured to be manipulated, said action figure being aligned with said second slot in said second plate.

3. The system according to claim 1, further comprising:

said action unit comprising:

said first plate having a first surface, a second surface and a peripheral edge extending therebetween, said peripheral edge having a first lateral side and a second lateral side, said first plate having a first slot extending through said first surface and said second surface, said first plate being positioned on said faceplate having said second surface abutting said faceplate, each of said fasteners having a pair of first arms and a second arm extending between each of said first arms, each of said first arms being coupled to said first surface of said first plate such that said second arm is spaced from said first surface, said plurality of fasteners including a pair of first fasteners and a pair of second fasteners, each of said first fasteners being positioned between said first lateral side of said first plate and said first slot, each of said second fasteners being positioned between said second lateral side of said plate and said first slot, a pair of couplers, each of said couplers being coupled to said second surface of said first plate, each of said couplers engaging said faceplate such that said first plate is retained on said faceplate, each of said retaining units comprising:

a button being configured to be manipulated, said button extending through said exterior wall of said second plate, a grip being coupled to said button such that said grip extends along said back surface of said second plate, said grip having a first leg and a first foot, said grip having a second leg and a second foot, said first leg and said second leg extending away from each other having each of said first foot and said second foot being directed toward said exterior wall, each of said first foot and said second foot extending between said first surface of said first plate and said second arm of an associated one of said fasteners such that said second plate is retained on said first plate, a stop being coupled to said back surface of said second plate, said stop being spaced from said grip, and a biasing member extending between said stop and said grip, said biasing member biasing each of said first foot and said second foot toward said exterior wall such that each of said first foot and said second foot engages said associated fastener, each of said first foot and said second foot disengaging said associated fastener when said button is manipulated such that said second plate is removable from said first plate, an action figure being movably coupled to said front surface of said second plate wherein said action figure is configured to be manipulated, said action figure being aligned with said second slot in said second plate, said action figure having a body, a plurality of limbs and a tail, each of said limbs and said tail being hingedly coupled to said body wherein each of said limbs and said tail is configured to be manipulated, said action figure including a saddle extending through said second slot, said saddle being operationally coupled to said tail, said saddle engaging said lever on said light switch such that said saddle turns said light switch on and off when said tail is manipulated; and said sound unit comprising:

a processor being coupled to said second surface of said second plate, said processor selectively generating an audible sequence, said processor being in electrical communication with said tail such that said processor generates said audible sequence when said tail is manipulated, said processor including an electronic memory, said electronic memory storing audio data, a speaker being coupled to said second surface of said second plate wherein said speaker is configured to emit an audible sound, said speaker being electrically coupled to said processor such that said speaker receives the audio data when said processor generates said audible sequence, and a power supply being coupled to said second surface of said second plate, said power supply being electrically coupled to said processor, said power supply comprising at least one battery.

4. The system according to claim 1, wherein each of said retaining units comprises a button being configured to be manipulated, said button extending through said exterior wall of said second plate.

5. The system according to claim 4, further comprising a grip being coupled to said button such that said grip extends along said back surface of said second plate, said grip having a first leg and a first foot, said grip having a second leg and a second foot, said first leg and said second leg extending away from each other having each of said first foot and said second foot being directed toward said exterior wall, each of said first foot and said second foot extending between said first surface of said first plate and said second arm of an associated one of said fasteners such that said second plate is retained on said first plate.

6. The system according to claim 5, further comprising a stop being coupled to said back surface of said second plate, said stop being spaced from said grip.

7. The system according to claim 6, further comprising a biasing member extending between said stop and said grip, said biasing member biasing each of said first foot and said second foot toward said exterior wall such that each of said first foot and said second foot engages said associated fastener, each of said first foot and said second foot disengaging said associated fastener when said button is manipulated such that said second plate is removable from said first plate.

8. The system according to claim 1, wherein said action unit comprises said first plate having a first surface, a second surface and a peripheral edge extending therebetween, said peripheral edge having a first lateral side and a second lateral side, said first plate having a first slot extending through said first surface and said second surface, said first plate being positioned on said faceplate having said second surface abutting said faceplate.

9. The system according to claim 8, further comprising a pair of couplers, each of said couplers being coupled to said second surface of said first plate, each of said couplers engaging said faceplate such that said first plate is retained on said faceplate.

10. The system according to claim 8, further comprising a plurality of fasteners, each of said fasteners having a pair of first arms and a second arm extending between each of said first arms, each of said first arms being coupled to said first surface of said first plate such that said second arm is spaced from said first surface.

11. The system according to claim 10, wherein said plurality of fasteners including a pair of first fasteners and a pair of second fasteners, each of said first fasteners being positioned between said first lateral side of said first plate and said first slot, each of said second fasteners being positioned between said second lateral side of said plate and said first slot.

12. An animated light switch system comprising:

a light switch being coupled to a wall wherein said light switch is configured to be manipulated, said light switch including a lever and a faceplate;

an action unit being coupled to said light switch wherein said action unit is configured to be manipulated, said action unit engaging said lever such that said action unit turns said light switch on and off when said action unit is manipulated, said action unit including a first plate;

a sound unit being coupled to said action unit wherein said sound unit is configured to emit an audible sound when said light switch is turned on and off;

a second plate having a first wall and an exterior wall extending outwardly from the first wall, said first wall having a front surface and a back surface, said exterior wall being coextensive with a perimeter of said back surface, said exterior wall having a first side and a second side, said first wall having a second slot extending therethrough; and an action figure being movably coupled to said front surface of said second plate wherein said action figure is configured to be manipulated, said action figure being aligned with said second slot in said second plate, wherein said action figure has a body, a plurality of limbs and a tail, each of said limbs and said tail being hingedly coupled to said body wherein each of said limbs and said tail is configured to be manipulated, said action figure including a saddle extending through said second slot, said saddle being operationally coupled to said tail, said saddle engaging said lever on said light switch such that said saddle turns said light switch on and off when said tail is manipulated.

13. An animated light switch system comprising:

a light switch being coupled to a wall wherein said light switch is configured to be manipulated, said light switch including a lever and a faceplate;

an action unit being coupled to said light switch wherein said action unit is configured to be manipulated, said action unit engaging said lever such that said action unit turns said light switch on and off when said action unit is manipulated, said action unit including a first plate;

a sound unit being coupled to said action unit wherein said sound unit is configured to emit an audible sound when said light switch is turned on and off;

a second plate having a first wall and an exterior wall extending outwardly from the first wall, said first wall having a front surface and a back surface, said exterior wall being coextensive with a perimeter of said back surface, said exterior wall having a first side and a second side, said first wall having a second slot extending therethrough;

an action figure having a tail; and said sound unit comprises a processor being coupled to said second surface of said second plate, said processor selectively generating an audible sequence, said processor being in electrical communication with said tail such that said processor generates said audible sequence when said tail is manipulated, said processor including an electronic memory, said electronic memory storing audio data.

14. The system according to claim 13, further comprising a speaker being coupled to said second surface of said second plate wherein said speaker is configured to emit an audible sound, said speaker being electrically coupled to said processor such that said speaker receives the audio data when said processor generates said audible sequence.

15. The system according to claim 14, further comprising a power supply being coupled to said second surface of said second plate, said power supply being electrically coupled to said processor, said power supply comprising at least one battery.

* * * * *